US005157933A

United States Patent [19]

Brendel

[11] Patent Number: 5,157,933

[45] Date of Patent: Oct. 27, 1992

[54] TRANSPORT REFRIGERATION SYSTEM HAVING MEANS FOR ACHIEVING AND MAINTAINING INCREASED HEATING CAPACITY

[75] Inventor: Thomas E. Brendel, Fayetteville, N.Y.

[73] Assignee: Carrier Corporation, Syracuse, N.Y.

[21] Appl. No.: 722,565

[22] Filed: Jun. 27, 1991

[51] Int. Cl.[5] ..... F25B 41/00

[52] U.S. Cl. ..... 62/196.4; 62/81; 62/278

[58] Field of Search ..... 62/196.4, 278, 81, 234

[56] References Cited

U.S. PATENT DOCUMENTS

| | | | |
|---|---|---|---|
| 4,122,686 | 10/1978 | Lindahl et al. | 62/278 X |
| 4,313,313 | 2/1982 | Chrostowski et al. | 62/278 |
| 4,720,980 | 1/1988 | Howland | 62/81 |
| 4,748,818 | 6/1988 | Satterness et al. | 62/278 X |
| 4,903,495 | 2/1990 | Howland et al. | 62/278 X |
| 4,912,933 | 4/1990 | Renken | 62/81 |
| 4,914,926 | 4/1990 | Gregory | 62/196.4 |

*Primary Examiner*—John Rivell

[57] ABSTRACT

A transport refrigeration system of the type which holds a set point by operating in heating and cooling cycles. The system includes a compressor, a condenser and an evaporator each having inlet and outlet ports. A three-way valve receives compressed gas discharged from the compressor and directs it selectively to first and second outlets. First outlet of the three-way valve directs hot compressor gas to the condenser for operation of the system in a conventional cooling cycle. A hot gas conduit is provided which connects the second outlet of the three-way valve directly to the inlet of the evaporator. A branch line extends from the hot gas line to the line interconnecting the condenser and the evaporator, upstream of the receiver. Another refrigerant line extends from the outlet of the condenser to establish fluid communication with the line interconnecting the outlet of the evaporator with the compressor suction port. Appropriate valve means are provided in the refrigerant lines such that, when appropriately actuated, the three-way valve directs hot gas only to the receiver. The portion of the liquid line which is downstream of the receiver, the hot gas line, and the line interconnecting the condenser outlet with the compressor suction line all are placed in fluid communication with the suction side of the compressor. The compressor then serves to draw down this portion of the refrigeration system to a low pressure thereby withdrawing the refrigerant therefrom and directing it via three-way valve and a portion of the hot gas line to the receiver.

11 Claims, 3 Drawing Sheets

TRANSPORT REFRIGERATION SYSTEM HAVING MEANS FOR ACHIEVING AND MAINTAINING INCREASED HEATING CAPACITY

BACKGROUND OF THE INVENTION

1. Field of the Invention

The invention relates in general to transport refrigeration systems, which hold a set point temperature by way of heating and cooling cycles, and more specifically to such systems which utilize hot compressor discharge gas for heating.

2. Description of the Prior Art

In the transportation of perishable products, it is recognized that it is necessary to provide refrigeration for the cargo space. It is also well known that it is necessary to periodically provide heat to remove the accumulation of frost or ice from the refrigeration system evaporator. Also, when transporting perishable products through areas having a cold climate, it is necessary to provide heat to the cargo space to prevent excessive cooling or freezing of the perishable products.

A well known method of providing heat for defrost and heating cycles is to divert hot compressor discharge gas from the normal refrigeration circuit directly to the evaporator to achieve the desired heating. It has been recognized that when such a switch from a cooling cycle to a heating cycle is made that a substantial amount of the refrigerant in the system is trapped in active parts of the system and accordingly not available for providing heat.

U.S. Pat. No. 3,219,102 "Method and Apparatus For Deriving Heat From Refrigerant Evaporator" teaches a system for delivering a hot compressed gas from the compressor to the receiver, to pressurize the receiver and thus force liquid refrigerant from the receiver into the remainder of the refrigeration circuit.

U.S. Pat. Nos. 4,748,818 and 4,912,933, both entitled "Transport Refrigeration System Having Means For Enhancing the Capacity Of A Heating Cycle", disclose a system that includes a refrigerant line that establishes fluid communication between the receiver and the suction accumulator in such a system. The '818 patent teaches that the refrigeration system simultaneously 1. Shift to the Heating Mode; and 2. Establish a fluid flow communication between the accumulator and the receiver. The '933 patent makes the interconnection between the accumulator and the receiver just prior to each heating cycle, while maintaining a cycle control valve in the cooling position for a pre-determined time delay. This forces any liquid refrigerant trapped in the condenser to flow into the receiver. A second mode of operation of the '933 patent calls for the establishment of the fluid communication between the accumulator and the receiver prior to the initiation of the heating cycle and further continues this fluid communication during the duration of the heating cycle.

Each of the '818 patent and the '933 patent may effectively serve to draw additional refrigerant into the heating circuit upon the initiation of a heating cycle. Once this initial withdrawal of refrigerant occurs, however, the capability of systems according to the '818 and '933 patents to draw additional refrigerant into the system is limited by the temperature/pressure of the condenser which, during heating is at ambient temperature. Such a limitation may create refrigerant inventory problems during periods of extended heating operation, particularly at low ambient temperatures.

It has been recognized that, during periods of extended continuous heating, minor valve leaks in transport refrigeration systems will result in refrigerant migrating back into the condenser and the refrigerant lines which are not active during the heating cycle. It will be appreciated that this tendency can be further aggravated during low ambient temperature conditions when the condenser coil represents the coldest point of the system.

SUMMARY OF THE INVENTION

It is an object of the present invention to insure that a transport refrigeration system of the type which holds a set point by operating in heating and cooling cycles always has sufficient refrigerant available for proper heating.

It is another object of the present invention to have the capability, at any time during a hot gas heating cycle, to shift to a pump down mode which draws refrigerant which has migrated into inactive areas back into the active heating circuit.

It is a further object of the present invention to assure that sufficient refrigerant is available for proper heating, while storing any excess liquid in the receiver where it is available on demand.

These and other objects of the present invention are achieved by a transport refrigeration system of the type which holds a set point by operating in heating and cooling cycles. The system includes a compressor, a condenser and an evaporator each having inlet and outlet ports. A three-way valve receives compressed gas discharged from the compressor and directs it selectively to first and second outlets. First outlet of the three-way valve directs hot compressor gas to the condenser for operation of the system in a cooling cycle. In the cooling cycle the refrigerant passes from the condenser through a refrigerant line which includes a receiver and an expansion valve and thence through the evaporator and back to the compressor. A hot gas conduit is provided which connects the second outlet of the three-way valve directly to the inlet of the evaporator. A branch line extends from the hot gas line to the line interconnecting the condenser and the evaporator, upstream of the receiver. Another refrigerant line extends from the outlet of the condenser to establish fluid communication with the line interconnecting the outlet of the evaporator with the compressor suction port. Appropriate valve means are provided in the refrigerant lines such that, when appropriately actuated, the three-way valve directs hot gas only to the receiver. The portion of the liquid line which is downstream of the receiver, the hot gas line, and the line interconnecting the condenser outlet with the compressor suction line all are placed in fluid communication with the suction side of the compressor. The compressor then serves to draw down this portion of the refrigeration system to a low pressure thereby withdrawing the refrigerant therefrom and directing it via the three-way valve and a portion of the hot gas line to the receiver.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will be best understood from the following description of the preferred embodiment when read in connection with the accompanying drawings wherein:

DESCRIPTION OF THE PREFERRED EMBODIMENT

Figure 1:
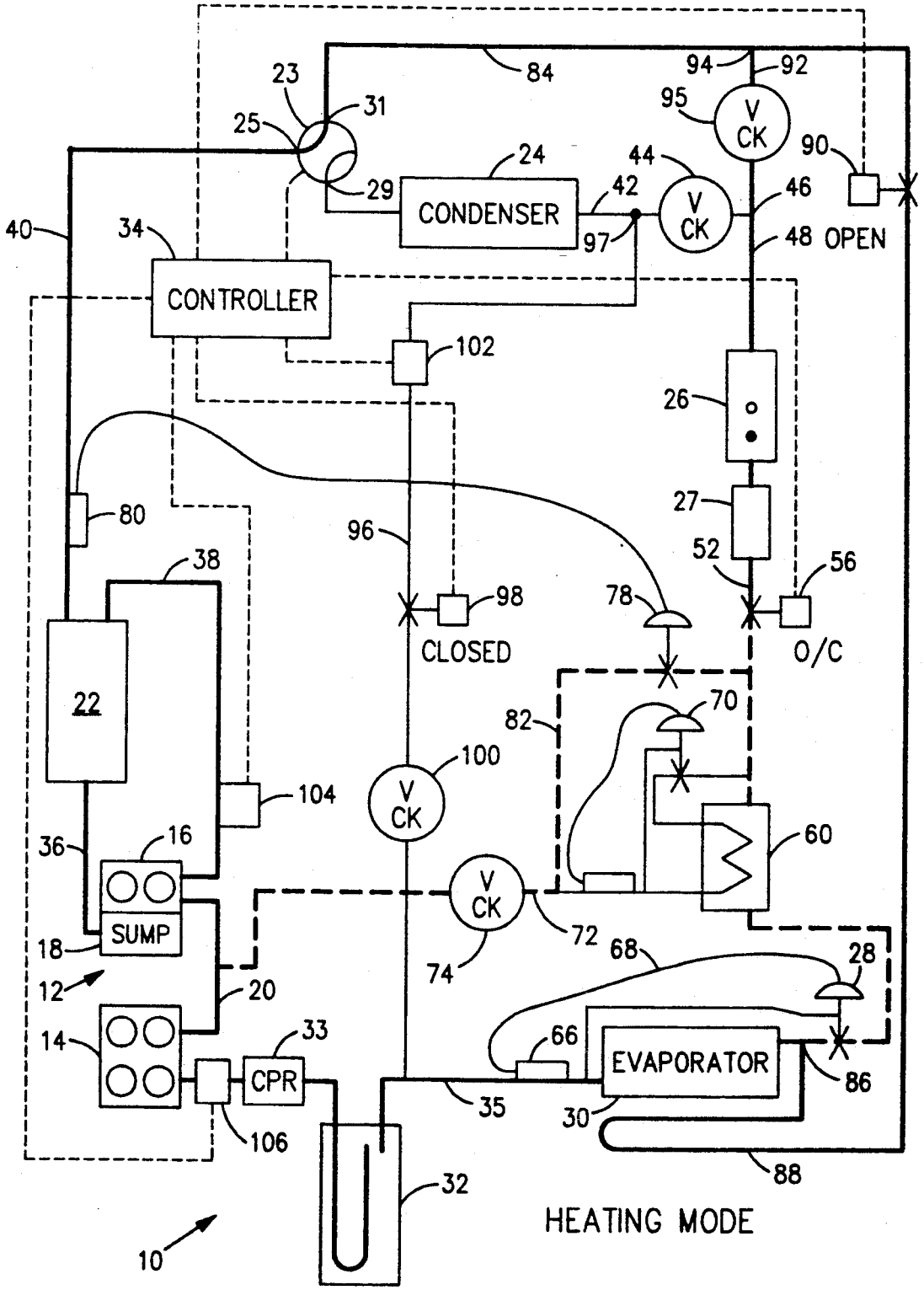
FIG. 1 is a diagrammatical representation of a transport refrigeration system embodying the principles of the present invention while operating in the heating mode.
Figure 2:
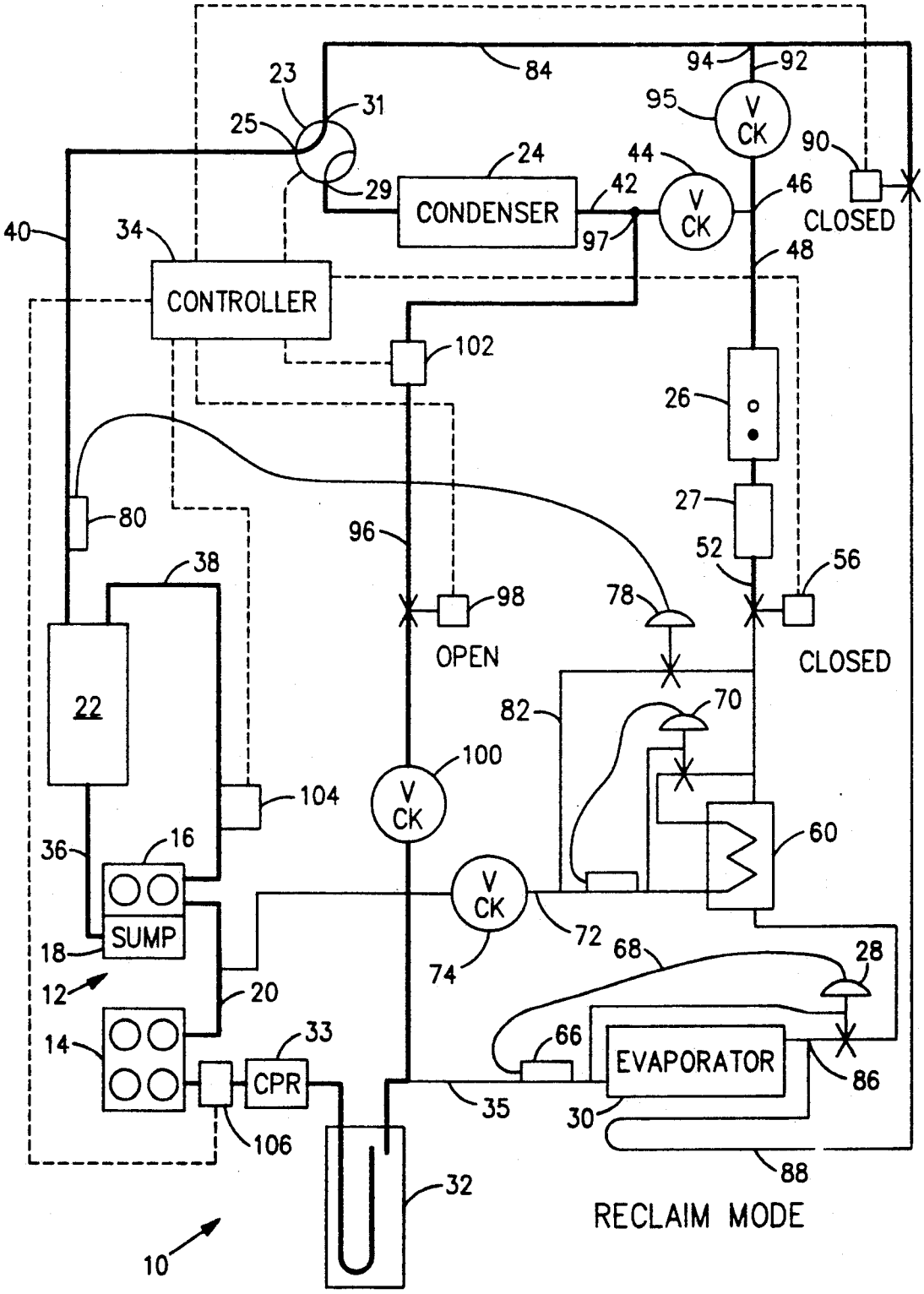
FIG. 2 is a diagrammatical representation similar to FIG. 1 operating in the refrigerant reclaim mode.

In both FIGS. 1 and 2, reference numeral 10, generally designates a compression refrigeration system of the type used in transport refrigeration applications. The system 10 is typically mounted on the front wall of a truck or truck trailer. The system includes a reciprocating compressor 12 having a first stage 14 and a second stage 16. As illustrated, the first stage 14 has four cylinders and the second stage 16 has two cylinders. While the compressor stages 14 and 16 are shown separately in the schematic drawings, it should appreciated that, in an integral two-stage reciprocating compressor, the stages typically share a single compressor block. They also share a reservoir of lubricating oil which is maintained in a crank case or sump 18 which shown in the drawing figures as associated with the second compressor state 16. The compressor 12 is in a refrigeration circuit which serially includes the first stage 14, an inter-stage cooling line 20, second stage 16, an oil separator 22, a three-way valve 23, condenser 24, receiver 26, filter dryer 27, thermostatic expansion valve 28, evaporator 30, accumulator 32, and compressor pressure regulator 33.

The compressor 12 is driven by an internal combustion engine, not shown in the drawings, in a conventional manner. The operation of the refrigeration circuit is fairly conventional and will be briefly described before a more detailed description of the heating mode of operation and the refrigerant reclaim mode of operation is given.

When the compressor 12 is driven by the engine, it compresses the refrigerant in the system, thereby raising its temperature and pressure and forces compressed refrigerant, along with a quantity of lubricating oil intermixed therewith through a discharge line 38 from the second stage 16 of the compressor. The discharge line 38 conducts the mixture to the oil separator 22, where the hot refrigerant gas and oil are separated from one another. Within the separator 22, the oil is collected and returned to the compressor sump via the oil return line 36.

The hot, substantially oil free, gaseous refrigerant passes from the oil separator 22 through separator discharge line 40 to the three-way valve 23 which is controlled by a microprocessor 34. In the refrigeration mode of operation, the valve 23 receives hot compressed refrigerant gas through an inlet 25 and directs it to the condenser 24, via a first outlet 29, where it condenses and passes via refrigerant line 42 through a check valve 44 to a T-connection 46 and from there via refrigerant line 48 to the receiver 26. Liquid refrigerant from the receiver passes through liquid line 52 through a filter dryer 27, through an electrically actuated liquid line solenoid valve 56, through an economizer heat exchanger 60 to the main thermostatic expansion valve 28. Liquid refrigerant passing through the thermostatic expansion valve 28 is partially flashed and dropped in pressure before reaching the evaporator 30 where the remaining liquid refrigerant evaporates and the gaseous refrigerant is supplied via refrigerant line 35, to the accumulator 32, through the compressor pressure regulator 33 and thence returned to the first stage 14 of the compressor to complete the cycle. The main expansion valve 28 is controlled by an expansion valve thermal bulb 66 and an equalizer line 68.

The illustrated embodiment includes both an inter-stage refrigerant gas cooling system and a compressor discharge gas cooling system. The inter-stage system is conventional and includes a thermostatic expansion valve 70 which expands a quantity of liquid refrigerant passing from the liquid line 52 through the economizer heat exchanger 60 and thence via an inter-stage injection line 72, having a check valve 74 therein to the inter-stage cooling line 20 interconnecting the low and high stages 14, 16 of the compressor 12.

The discharge temperature control system includes a valve 78 which is operated responsive to the outlet temperature of the second stage 16 as sensed by a temperature sensor 80 and controls the flow of refrigerant through line 82 to the inter-stage cooling line 20 to obtain the desired compressor discharge temperature.

In the heating mode of operation, as shown in FIG. 1, the three-way valve 23 is operated such that the hot gas from the compressor is directed from the second outlet 31 of the three-way valve to a hot gas line 84 which extends to a T-connection 86 in the liquid line 52 which interconnects the receiver and the evaporator, downstream of the main thermal-expansion valve 28. The hot gas line 84, also passes through a drain pan heater 88 located below the evaporator coil 30. An electrically actuatable solenoid valve 90 is located in the hot gas line in relatively close proximity to the three-way valve 23. This valve selectively allows refrigerant to pass therethrough when actuated to its open position or will prevent the flow of refrigerant therethrough when actuated to its closed position. Additional electrically actuatable solenoid valves contained in the system operate in the same conventional manner. A branch conduit 92 extends from a T-connection 94 in the hot gas line 84 and establishes fluid communication with the T-connection 46. The branch conduit includes a one-way check valve 95 which allows flow only in the direction from the three-way valve 23 to the receiver 26.

A refrigerant reclaim conduit 96 extends from a T-connection 97 located in the refrigerant line 42 passing from the condenser at a location upstream from the check valve 44. The reclaim conduit 96 establishes fluid communication between the outlet of the condenser 24 and the refrigerant line 35 communicating the outlet of the evaporator 30 with the accumulator 32. The reclaim conduit 96 has an electrically actuatable solenoid valve 98 disposed therein in close proximity to the condenser 24, and, a one-way check valve 100 downstream thereof which allows the flow of refrigerant only in the direction from the condenser to the accumulator. A pressure transducer 102 is also located in the reclaim line 96.

Automatic control of all of the components of the refrigeration system is carried out by a previously referred to electronic controller 34 which is preferably formed of a microprocessor having a memory storage capability and which is microprogrammable to control the operation of the system components. Of particular interest in connection with the present invention is control of the three-way valve 23, and each of the solenoid valves 56, 90, and 98. Also as shown in the drawings the controller is adapted to receive an input signal from the reclaim line pressure transducer 102, a compressor discharge line pressure transducer 104, and, a compressor suction line pressure transducer 106.

Now that the components of the refrigerant reclaim system have been described, the condition of the various control valves of the system will be briefly discussed in connection with the cooling and heating modes of operation before the operation of the reclaim system is described in detail. In the cooling mode the three-way valve 23 operates to direct refrigerant through first outlet port 29 directly to the condenser. At this time the solenoid valve 90 in the hot gas line 84 and the solenoid valve 98 in the reclaim line 96 are both closed. As a result, the refrigerant is passed from the condenser through the liquid line solenoid valve 56, which is open, in a conventional refrigeration circuit as was described above.

In the heating mode of operation, three-way valve 23 is operated to direct the hot gas from the second outlet 31 to the hot gas line. At this time the hot gas solenoid valve 90 is open to allow the flow of hot gas to the drain pan heater 88 and evaporator 30 to effect heating thereof for either heating the load space being served or for defrost purposes as is conventional. At this time, the reclaim solenoid valve 98 remains closed.

During the heating mode the liquid line solenoid valve 56 may be open or closed depending upon the control signal it receives from the controller 34 which is responding to a pressure signal from the discharge line pressure transducer 104. When this valve is open during the heating mode it is done so in order to limit compressor discharge pressure by allowing high pressure liquid refrigerant in the receiver to be bled through the main thermal expansion valve 28 or the discharge temperature control expansion valves 70 or 78.

Turning now to the refrigerant reclaim mode of operation. The reclaim may be carried out in a two-step process or a one-step process. The two-step is most effective when performed when the system controller 34 has indicated the need for a heating or defrost mode of operation and just prior to going into the actual heating mode. In the first step the controller 34 will simultaneously operate the three-way valve 23 to direct the hot gas to the hot gas conduit 84, close the hot gas line solenoid valve 90, and close the liquid line solenoid valve 56. Under these conditions the discharge from the compressor is directed through the three-way valve 23 to the hot gas line and through the T-connections 94 and 46 to the receiver 26. The suction side of the compressor 12 is in fluid communication with the refrigerant lines extending from the hot gas line solenoid valve 90 and the liquid line solenoid valve 56. At this time the compressor suction serves to pump down this portion of the refrigeration system and to pull out of the conduits and components residual liquid refrigerant that has been dormant in the drain pan heater and the hot gas bypass and serves to flush out any liquid refrigerant drawn into the evaporator from these lines. The system will operate in this mode for a predetermined period of time, for example 40 seconds to a minute or until a suitable pressure reading is achieved as for example at the compressor suction pressure transducer 106.

Following performance of the above described first step, the second step of the reclaim cycle is initiated by opening the reclaim solenoid valve 98. At this time compressor suction then serves to evacuate virtually all of the liquid refrigerant from the first outlet 29 of the three-way-valve down through the condenser and through the reclaim line 96. The main reclaim operation may be performed for a predetermined time period as programmed into the controller 34 or it may be terminated by a signal from the pressure transducer 102 in the reclaim line 96 or the suction line pressure transducer 106.

It should be appreciated that as so operated the system is able to draw down the pressure within the condenser 24, the liquid line 52 and the heating line 84 to a level commensurate with the pressure ratio which the compressor 12 is capable of developing. As an example, in the disclosed embodiment the compressor is two-stage and it is possible to develop an overall pressure ratio of 400 to one. In such a case with ambient, discharge conditions of, for example, 50° F. which for R-22 is a saturation pressure of approximately 84 psig a two-stage system would be capable of pulling down the components being evacuated to approximately 29.4 inches of mercury below one atmosphere at which equals a saturation temperature of below minus 150° F. For a single stage compressor capable of developing a pressure ratio of 60 to one, for the same ambient conditions, the part of the system being pumped down could be drawn down to 26.6 inches of mercury below one atmosphere which equals a saturation temperature of about minus 110° F.

Figure 3:
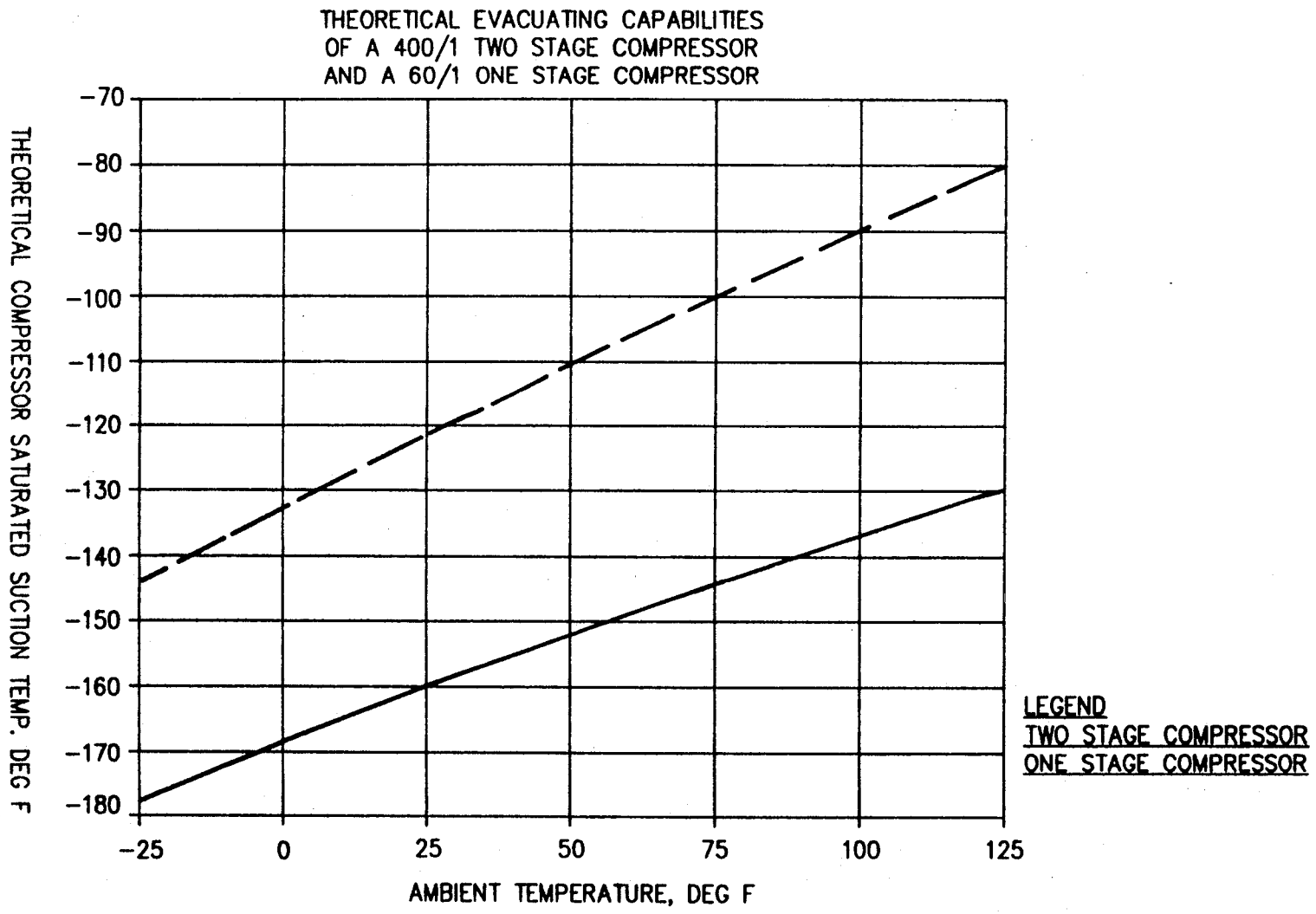
FIG. 3 is a graphical representation of the theoretical evacuation capabilities of several refrigerant compressors.

These figures are representative of what may be achieved with the reclaim system. The graph of FIG. 3 shows the theoretical evacuating capabilities of a 400:1 two stage compressor and a 60:1 one stage compressor for a wide range of ambient temperatures. All values are for R-22.

The reclaim system has been described in connection with the initiation of a heating cycle in order to bring the maximum amount of refrigerant into circulation in the heating circuit. A further substantial benefit of the system of the present invention is that at any time during a heating or defrost cycle the system may be shifted into a temporary reclaim mode of operation with very little sacrifice during that temporary mode of system heating capability.

As pointed out above in the background of the invention, during a period of extended heating operation minor leaks in the various valves of the system may result in quantities of liquid refrigerant migrating to inactive colder parts of the system. The system of the present invention may be microprocessor controlled to shift to a temporary reclaim mode during the course of such extended heating operation to reclaim such migrated refrigerant and draw it back into the heating circuit. The microprocessor may be programmed, for example, to shift to a temporary reclaim cycle if the system has not shifted to cooling for a predetermined period of time, for example 6 hours. The shift to a temporary reclaim mode could also be strictly timed for example, during heating mode going into a temporary reclaim cycle every four hours or some other predetermined time. Another control option for shifting to a temporary reclaim mode would be pressure, for example the discharge pressure of the compressor could be sensed and the system actuated when it falls below a predetermined value.

Whatever event has been programmed into the microprocessor to actuate a temporary reclaim cycle, and it may be more than one event, when a reclaim signal is received the controller will close the hot gas line solenoid valve 90, close the liquid line solenoid valve 56, and, open the reclaim solenoid valve 98 thereby immediately putting the system into a pump down mode and drawing refrigerant that has migrated to the inactive parts of the system back into the heating circuit as described above.

It should accordingly be appreciated that a system has been provided which will allow a transport refrigeration system of a type which holds a set point temperature by way of heating and cooling cycles to achieve and maintain an increased heating capacity at any time during the operation of a heating cycle.

What is claimed is:

1. A transport refrigeration system which holds a set point by operating in heating and cooling cycles comprising;

a compressor for compressing gaseous refrigerant delivered thereto, said compressor having a suction port and a discharge port;

a condenser for passing refrigerant therethrough, said condenser having an inlet and an outlet;

an evaporator for passing refrigerant therethrough, said evaporator having an inlet and an outlet;

cycle selection valve means having an inlet means for receiving compressed gas discharged from said outlet of said compressor, said valve means having first and second outlets through which compressed gas may be selectively discharged;

first conduit means for connecting said first outlet of said valve means with said inlet of said condenser;

second conduit means for connecting said outlet of said condenser with said inlet of said evaporator;

third conduit means for connecting said outlet of said evaporator with said suction port of said compressor;

fourth conduit means for connecting said second outlet of said valve means with said inlet of said evaporator;

an expansion device disposed in said second conduit;

fifth conduit means for connecting said fourth conduit with said second conduit at a location between said condenser outlet and said expansion device;

a first check valve disposed in said fifth conduit, said valve allowing flow only in the direction from said fourth conduit to said second conduit;

sixth conduit means for connecting said condenser outlet with said third conduit;

first valve means disposed in said sixth conduit for selectively allowing no flow through said sixth conduit and allowing flow only in the direction from said condenser outlet to said third conduit;

a second check valve means disposed in said second conduit at a location between said condenser outlet and said connection with said fifth conduit, said valve allowing flow only in the direction from said condenser to said evaporator;

a receiver disposed in said second conduit at a location in between said connection with said fifth conduit and said expansion device;

second valve means disposed in said second conduit in between said receiver and said expansion device, said second valve being operable between an open and closed condition; and third valve means disposed in said fourth conduit, said third valve being operable between an open and a closed condition.

2. The apparatus of claim 1 including;

control means for providing a heat signal when the need for a heating cycle is detected, means responsive to said heat signal for implementing a refrigerant reclaim mode of operation, prior to initiating a heating cycle, by;

operating said cycle selection valve means to direct hot refrigerant gas to said second outlet;

operating said first valve means to an open condition;

operating said second valve means to a closed condition; and operating said third valve means to a closed condition;

whereby the suction of the compressor will serve to evacuate refrigerant from all system components downstream from said three-way valve, said second valve means, and said third valve means;

means for terminating the reclaim mode of operation, and for initiating a heating mode of operation, when a pre-determined event occurs, by;

continuing to operate said cycle selection valve to direct refrigerant to said second outlet;

operating said first valve means to a closed condition;

continuing to operate said second valve means to a closed condition; and operating said third valve means to an open condition.

3. The apparatus of claim 2 wherein said means for terminating the reclaim mode of operation and for initiating a heating mode comprises;

means for sensing pressure upstream from said compressor suction port, and, for providing a signal indicative of this pressure;

means for processing said pressure signal and for terminating the reclaim mode and initiating the heating mode when said pressure signal reaches a value indicative of a pre-determined pressure.

4. The apparatus of claim 2 wherein said means for terminating the reclaim mode of operation, and, for initiating a heating mode comprises;

timer means, set at a predetermined time for terminating said reclaim mode of operation and initiating said heating mode of operation.

5. The apparatus of claim 1 including;

control means for providing a heat signal when the need for a heating cycle is detected;

means responsive to said heat signal for implementing a refrigerant pre-reclaim mode of operation, prior to initiating a reclaim mode and a heating mode, by;

operating said cycle selection valve to direct refrugerant to said second outlet;

operating said first valve means to a closed condition;

operating said second valve means to a closed condition; and operating said third valve means to a closed condition;

means for initiating a reclaim mode of operation, after performing the pre-reclaim mode for a predetermined time by;

continuing to operate said cycle selection valve to direct refrigerant to said second outlet;

operating said first valve means to an open condition;

continuing to operate said second valve means to a closed condition; and continuing to operate said third valve means to a closed condition;

means for terminating the reclaim mode of operation and initiating a heating mode of operation when a predetermined event occurs, by;

continuing to operate said cycle selection valve to direct refrigerant to said second outlet;

operating said first valve means to a closed condition;

continuing to operate said second valve means to a closed condition; and operating said third solenoid valve means to an open condition.

6. The apparatus of claim 1 wherein said first valve means comprises:

a check valve allowing flow only in the direction from said condenser to said third conduit; and a solenoid actuated valve operable between an open and a closed condition.

7. The apparatus of claims 1 wherein said compressor is a two-stage compressor.

8. The apparatus of claim 1 wherein said cycle selection valve means comprises a three-way-valve.

9. The apparatus of claim 1 including;

control means for operating the system in a heating cycle by operating said cycle selection valve to direct compressed gaseous refrigerant to said second outlet;

operating said first valve means to a closed condition;

operating said second valve means to an open condition; and, operating said third valve means to an open condition.

10. The apparatus of claim 9 including;

means for determining the need for a refrigerant reclaim cycle and, for providing a reclaim signal when the need is determined during a heating cycle;

said control means, responsive to said reclaim signal for;

continuing to operate said cycle selection valve to direct refrigerant to said second outlet;

operating said first valve means to an open condition, operating said second valve means to a closed condition, and, operating said third valve means to a closed condition;

whereby, the suction of the compressor will serve to evacuate refrigerant from all system components downstream of said cycle selection valve, said second valve means, and said third valve means.

11. The apparatus of claim 9 further including means for sensing compressor discharge pressure and for providing a signal indicative of this pressure;

said control means including means for selectively opening and closing said second value means responsive to said discharge pressure signal being at a predetermined value.

* * * * *